US006946943B2

(12) United States Patent
Ito

(10) Patent No.: US 6,946,943 B2
(45) Date of Patent: Sep. 20, 2005

(54) STICK-SHAPED IGNITION COIL HAVING POSITIONING STRUCTURE

(75) Inventor: Shigeki Ito, Inabe (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/047,869

(22) Filed: Feb. 2, 2005

(65) Prior Publication Data

US 2005/0184845 A1 Aug. 25, 2005

(30) Foreign Application Priority Data

Feb. 25, 2004 (JP) ..... 2004-049809
Nov. 11, 2004 (JP) ..... 2004-327704

(51) Int. Cl.[7] ..... H01F 27/02
(52) U.S. Cl. ..... 336/90
(58) Field of Search ..... 336/65, 90–96, 336/107, 192, 198; 123/634–635

(56) References Cited

U.S. PATENT DOCUMENTS 6,011,457 A * 1/2000 Sakamaki et al. ..... 336/96
6,622,712 B2 * 9/2003 Nakashima et al. ..... 123/634
6,639,498 B2 * 10/2003 Shimada et al. ..... 336/96

FOREIGN PATENT DOCUMENTS

JP A-9-222067 11/1996
JP B2-3393770 3/2003

* cited by examiner

*Primary Examiner*—Tuyen T. Nguyen
(74) *Attorney, Agent, or Firm*—Nixon & Vanderhye P.C.

(57) ABSTRACT

A stick-shaped ignition coil includes a center core, a primary and secondary coils arranged on the radially outer side of the center core, a metallic outer core arranged on the radially outer side of the primary and secondary coils, an upper case connected to the upper end of the primary and secondary coils, and at least one positioning portion formed on the radially outer periphery of the upper case. The upper case and the positioning portion are at least partially received in the plughole. The positioning portion is in proximity to or makes contact with the inner periphery of in the plughole in the radial direction of the plughole. Thus, the ignition coil can be properly positioned in the plughole formed in a cylinder head of an internal combustion engine.

22 Claims, 4 Drawing Sheets

STICK-SHAPED IGNITION COIL HAVING POSITIONING STRUCTURE

CROSS REFERENCE TO RELATED APPLICATIONS

This application is based on and incorporates herein by reference Japanese Patent Applications No. 2004-49089 filed on Feb. 25, 2004 and No. 2004-327704 filed on Nov. 11, 2004.

FIELD OF THE INVENTION

The present invention relates to a stick-shaped ignition coil that generates high-voltage electric power supplied to an ignition plug, which ignites mixture gas in an internal combustion engine.

BACKGROUND OF THE INVENTION

A stick-shaped ignition coil includes a coil portion, a control portion, and a tower portion. The coil portion is located in an axially intermediate position of the ignition coil. The control portion is located on the upper end side of the ignition coil. The tower portion is located on the lower end side of the ignition coil. The tower portion and the coil portion are inserted into a plughole formed in a cylinder head of the engine. The control portion protrudes from the upper plane of the cylinder head. The diameters of both the coil portion and the tower portion are determined to be slightly smaller than the inner diameter of the plughole, so that the coil portion and the tower portion can be easily inserted into the plughole. Specifically, the diameters of both the coil portion and the tower portion are within a range from 20 mm to 22 mm. The diameter of the control portion is within a range from 23 mm to 25 mm. Therefore, an annular gap is formed between the coil portion and the plughole, and another annular gap is formed between the tower portion and the plughole. The coil portion and the tower portion may be radially vibrated within the annular gap due to vibration of the engine. Accordingly, a radially positioning portion needs to be provided to the ignition coil to reduce vibration of the outer circumferential periphery of the coil portion with respect to the inner circumferential periphery of the plughole.

As shown in FIG. 7, a conventional ignition coil for an internal combustion engine, which is disclosed in JP-B2-3393770, includes a coil portion 100 that has a cylindrical resinous case 101 receiving primary and secondary coils (not shown). An upper positioning protrusion 103 is formed in the vicinity of the upper end portion of the cylindrical resinous case 101. A lower positioning protrusion 104 is formed in the vicinity of the lower end portion of the cylindrical resinous case 101. Both the upper and lower positioning protrusions 103, 104 respectively protrude radially outwardly from the outer circumferential periphery of the resinous case 101. Tip ends of the upper and lower positioning protrusions 103, 104 respectively make contact with the inner periphery of the plughole 106 in the radial direction thereof. Alternatively, the tip ends of the upper and lower positioning protrusions 103, 104 are respectively in proximity radially to the inner periphery of the plughole 106. Thus, the coil portion 100 is protected from vibrating in the plughole 106.

However, the outer diameter of a coil portion of an ignition coil needs to be decreased, because of decrease of the inner diameter of the plughole in recent years. Therefore, the resinous case 101 is reduced from the conventional coil portion 100, and a thin film sheet is provided to the ignition coil instead of the resinous case 101. The thin film sheet is circumferentially covered with a metallic outer core that is exposed to the outermost periphery of the coil portion. In this structure, a positioning member may not be easily formed on the outer circumferential periphery of the metallic outer core. Accordingly, the coil portion may not be properly positioned in the plughole.

SUMMARY OF THE INVENTION

In view of the foregoing problems, it is an object of the present invention to produce a stick-shaped ignition coil that has a positioning portion for radially positioning a coil portion in the plughole, even when a metallic outer core is exposed to the outermost periphery of the coil portion to decrease the outer diameter of the coil portion.

According to the present invention, a stick-shaped ignition coil, which is received in a plughole formed in a cylinder head of an internal combustion engine, includes a coil portion, a first portion, and at least one first positioning portion.

The coil portion includes a center core, a secondary coil, primary coil, and an outer core. The secondary coil is arranged on the outer circumferential side of the center core. The secondary coil includes a secondary spool and a secondary winding. The secondary winding is wound around the secondary spool. The primary coil is arranged on the outer circumferential side of the center core. The primary coil includes a primary spool and a primary winding. The primary winding is wound around the primary spool. The secondary coil and the primary coil are substantially coaxially arranged. The outer core is arranged on the outer circumferential side of one of the primary coil and the secondary coil that is arranged on the outer circumferential side with respect to the other of the primary coil and the secondary coil. The outer core is arranged on the outermost side of the coil portion in the radial direction of the coil portion. The outer core has a middle portion that is located at the center of the outer core in the axial direction of the outer core. The first portion is connected to an upper end portion of the coil portion. The first portion is apart from the middle portion of the outer core in the axial direction of the outer core.

The at least one first positioning portion is formed on the first portion. The at least one first positioning portion is in proximity to the inner circumferential periphery of a first hole portion, which is formed in the plughole, in the radial direction of the plughole. Alternatively, the at least one first positioning portion makes contact with the inner circumferential periphery of the first hole portion, which is formed in the plughole, in the radial direction of the plughole.

The upper end portion of the coil portion is located on the opposite side as an ignition plug, which is inserted into a combustion chamber formed in the internal combustion engine, with respect to the outer core. The first portion is an upper case. The plughole has the first hole portion and a second hole portion. The first hole portion is formed on a side of an inlet of the plughole with respect of the second hole portion. The first hole portion is arranged on the opposite side as the combustion chamber of the internal combustion engine with respect to the second hole portion. The first hole portion has the inner diameter that is greater than the inner diameter of the second hole portion. The first portion is at least partially received in the first hole portion. The at least one first positioning portion is formed on the outer circumferential periphery of the first portion such that the at least one first positioning portion is at least partially received in the first hole portion. The at least one first positioning portion is at least partially in proximity to the inner circumferential periphery of the first hole portion in the radial direction of the plughole.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
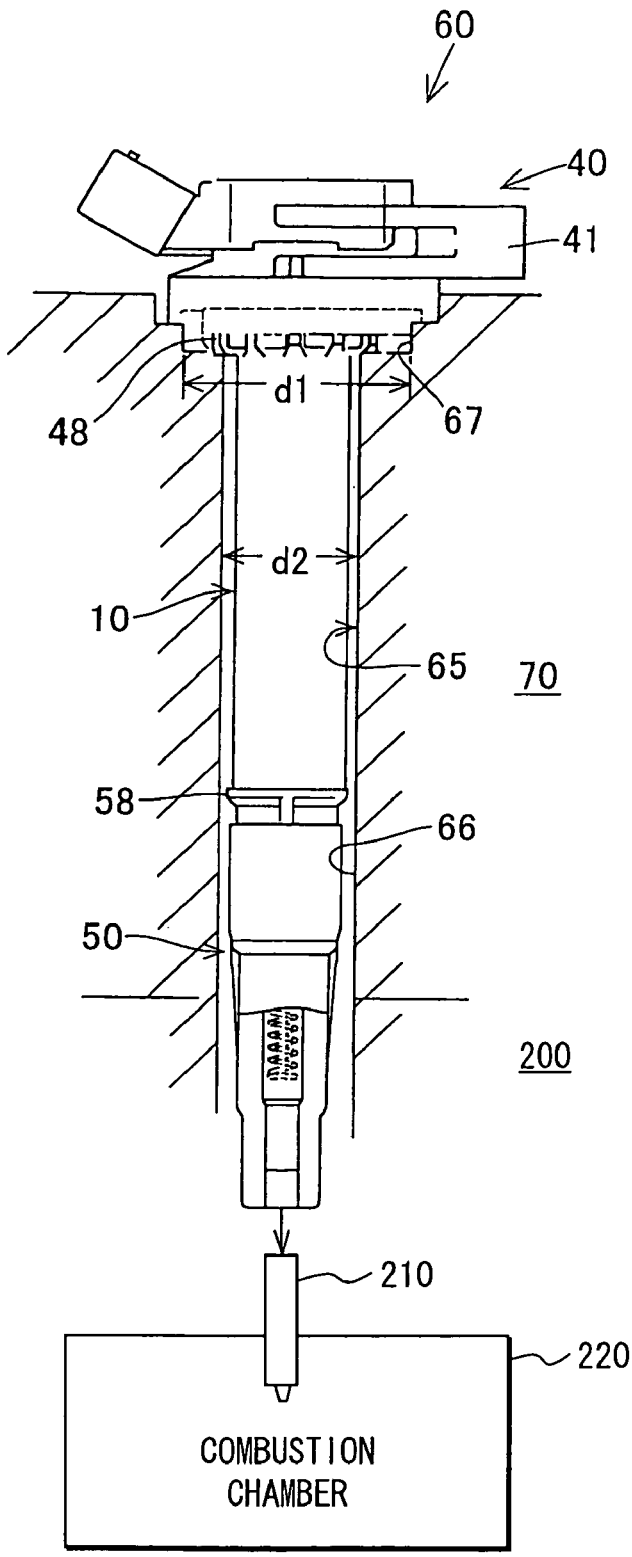
FIG. 1 is a partially cross-sectional side view showing an ignition coil according to a first embodiment of the present invention.

As shown in FIG. 1, a stick-shaped ignition coil 60 is inserted into a plughole 65 formed in a cylinder head 70 of an internal combustion engine 200. The plughole 65 has a small-diameter long hole (second hole portion, small-diameter hole portion) 66 and a large-diameter short hole (first hole portion, large-diameter hole portion) 67. The small-diameter long hole 66 has a substantially circular cross section that is longitudinally substantially uniform in inner diameter. The large-diameter short hole 67 is formed on the inlet side, i.e., on the side of the upper end of the small-diameter long hole 66 such that the large-diameter short hole 67 has a substantially circular cross section that is longitudinally substantially uniform in inner diameter. The inner diameter of the small-diameter long hole 66 is in a range from substantially 16 mm to substantially 22 mm. An ignition plug 210 is fixed to the bottom portion of the small-diameter long hole 66. The ignition plug 210 is inserted into the combustion chamber 220 of the internal combustion engine 200, so that the ignition plug 210 is exposed to the combustion chamber 220 to generate combustion in the combustion chamber 220. The inner diameter d1 of the large-diameter short hole 67 is set to be greater than the inner diameter d2 of the small-diameter long hole 66. The small-diameter long hole 66 is located on an opposite side as an opening end portion of the plughole 65, which is on the upper end side in FIG. 1, with respect to the large-diameter short hole 67.

The ignition coil 60 inserted into the plughole 65 includes a coil portion 10, a control portion 40, and a tower portion 50. The coil portion 10 is located in an axially intermediate position of the ignition coil 60. The control portion 40 is located on one end (upper end) side of the ignition coil 60. The tower portion 50 is located on the other end (lower end) side of the ignition coil 60. The tower portion 50 and the coil portion 10 are inserted into the small-diameter long hole 66. The control portion 40 is partially received in the large-diameter short hole 67.

Figure 2:
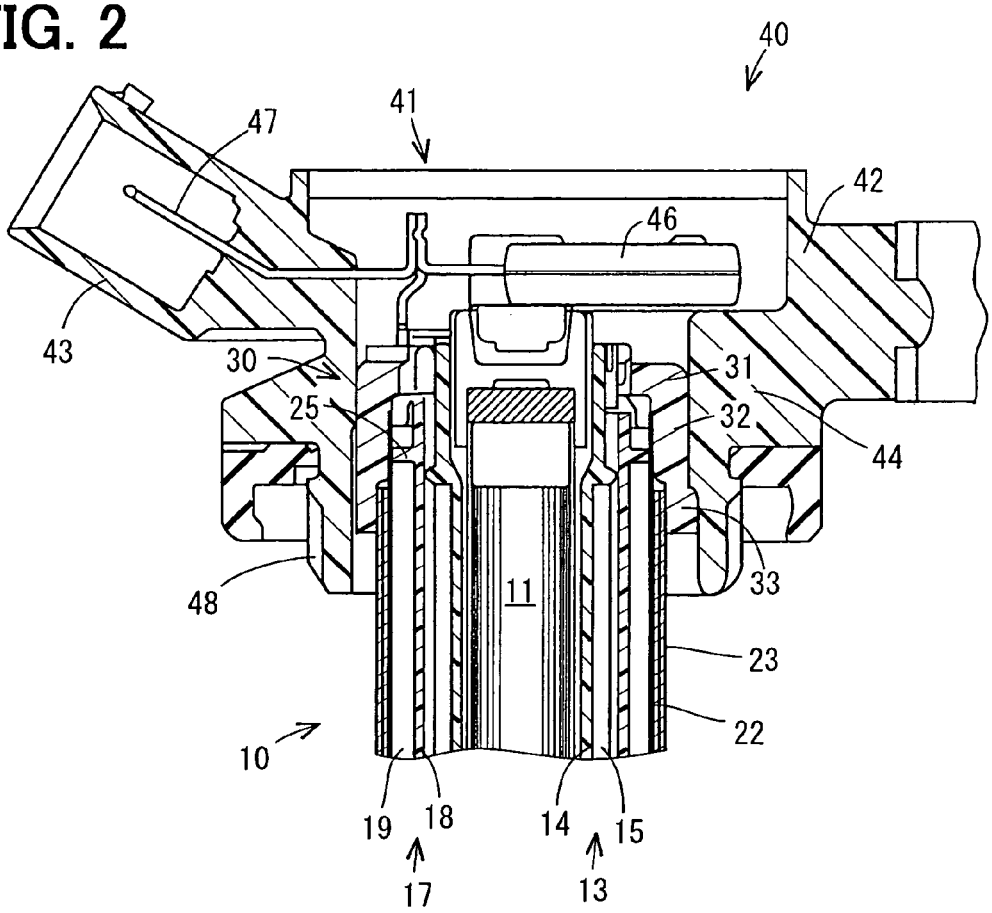
FIG. 2 is an enlarged partially cross-sectional side view showing a coil portion and a control portion of the ignition coil according to the first embodiment.

As shown in FIG. 2, the coil portion 10 and the control portion 40 are connected to each other via a terminal assembly 30 in the ignition coil 60. The terminal assembly 30 is formed in a substantially cylindrical shape. A center core 11, a secondary coil 13, a primary coil 17, a thin film sheet 22 and an outer core 23 are arranged in the coil portion 10 from the center to the side of the outer periphery in order. The secondary coil 13 includes a secondary spool 14, which is formed in a substantially cylindrical shape, and a secondary winding 15 that is wound around the outer circumferential periphery of the secondary spool 14. The secondary spool 14 is electrically insulative. The primary coil 17 includes a primary spool 18, which is formed in a substantially cylindrical shape, and a primary winding 19 that is wound around the outer circumferential periphery of the primary spool 18. The primary spool 18 is electrically insulative. A collar portion 25 is formed on the upper end portion of the primary spool 18, which is located on the outer circumferential side in the coil portion 10.

Figure 5:
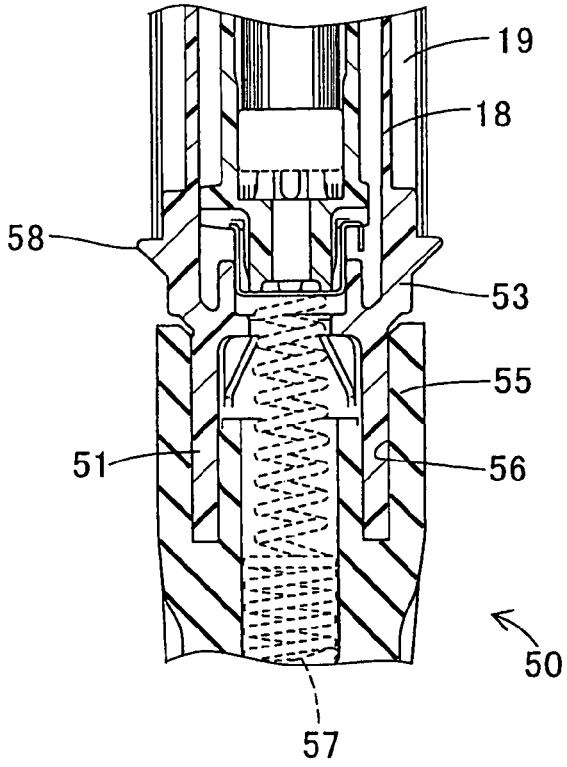
FIG. 5 is an enlarged partially cross-sectional side view showing a high-voltage tower portion of the ignition coil according to the first embodiment.

As shown in FIG. 5, the primary spool 18 is integrally formed with the tower case 51.

As referred to FIG. 2, the primary winding 19 is covered with a thin film sheet 22 that is formed of a thin film to be in a cylindrical shape. The top end of the thin film sheet 22 extends to the top end of the primary spool 18 axially over the collar portion 25.

Figure 3:
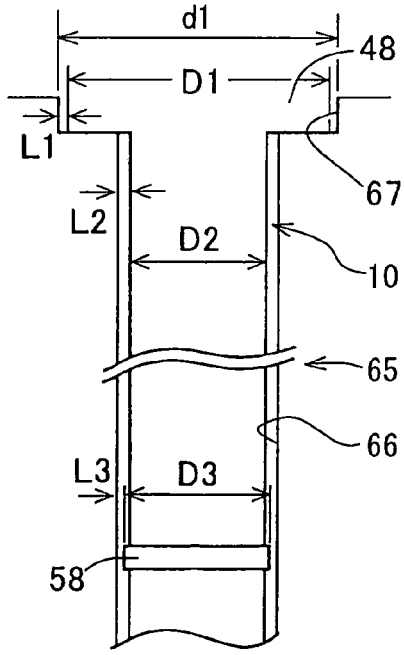
FIG. 3 is a schematic side view showing the ignition coil inserted into a plughole according to the first embodiment.

A thin outer core 23, which is small in thickness, is provided on the side of the outer periphery of the thin film sheet 22. That is, the thin outer core 23 is arranged on the radially opposite side as the primary winding 19 with respect to the thin film sheet 22 such that the thin outer core 23 entirely covers the primary winding 19. The outer core 23 forms the outermost portion of the coil portion 10 such that the outer core 23 is exposed to the outermost periphery of the coil portion 10. The outer diameter of the coil portion 10 is within a range from substantially 15 mm to substantially 21 mm. As shown in FIG. 3, the outer diameter of the coil portion 10 is D2, and the inner diameter of the small-diameter long hole 66 is d2. The gap formed between the outer circumferential periphery of the coil portion 10 and the inner circumferential periphery of the small-diameter long hole 66 has a length of L2 in the radial direction thereof.

The terminal assembly 30 shown in FIG. 2 is formed of an electrically insulative material to be in a substantially cylindrical shape. The terminal assembly 30 includes an upper end portion 31, an intermediate portion 32, and a lower end portion 33. The outer diameter and the inner diameter of the upper end portion 31 are smallest in the terminal assembly 30. The outer diameter and the inner diameter of the lower end portion 33 are largest in the terminal assembly 30. The outer diameter and the inner diameter of the intermediate portion 32 are respectively between those of the upper end portion 31 and those of the lower end portion 33 in the terminal assembly 30. The inner diameter of the intermediate portion 32 is substantially the same as the outer diameter of the collar portion 25 of the primary spool 18. The inner diameter of the lower end portion 33 corresponds to the outer diameter of the outer core 23. The outer diameter of the intermediate portion 32 and the outer diameter of the lower end portion 33 are substantially the same as an inner diameter of a connecting portion 44 of an upper case (first portion) 41.

The upper end portion of the secondary winding 15 upwardly extends to the upper end plane of the upper end portion 31 of the terminal assembly 30 through a hollow portion of the upper end portion 31, and the end portion of the secondary winding 15 is electrically connected with a primary terminal (not shown). The upper end portion of the primary winding 19 upwardly extends over the collar portion 25 of the primary spool 18 to the upper end plane of the upper end portion 31 of the terminal assembly 30 through a hollow portion of the upper end portion 31. The end portion of the primary winding 19 is electrically connected with a secondary terminal (not shown).

Gaps, which are formed in the coil portion 10, such as a gap formed between the secondary winding 15 and the primary spool 18, and a gap formed between the primary winding 19 and the thin film sheet 22 are filled with electrically insulative resin. The intermediate portion 32 of the terminal assembly 30 tightly makes contact with the outer circumferential periphery of the thin film sheet 22, which extends to the upper end of the primary spool 18, so that the intermediate portion 32 seals a space formed between the primary winding 19 and the thin film sheet 22.

The upper case 41 of the control portion 40, which serves as a circuit case, includes a receiving portion 42, a connector portion 43, and the connecting portion 44. The upper case 41 is electrically insulative. An igniter 46 is arranged in the receiving portion 42 of the upper case 41, which is formed in a box shape. A terminal 47 is provided to the inside of the connector portion 43 that extends from the minus side of the receiving portion 42. The terminal 47 is electrically connected with both the igniter 46 and the other end portion of the primary winding 19. The space around the igniter 46 in the receiving portion 42 is filled with an electrically insulative resin (not shown).

The connecting portion 44, which extends from the lower plane of the receiving portion 42, is in a substantially cylindrical shape. The inner diameter of the connecting portion 44 is substantially the same as the outer diameter of the upper end portion 31 of the terminal assembly 30. The terminal assembly 30 is press-inserted into the primary spool 18, and the connecting portion 44 is press-inserted into the terminal assembly 30, so that the control portion 40 is fixed to the coil portion 10.

Figure 4:
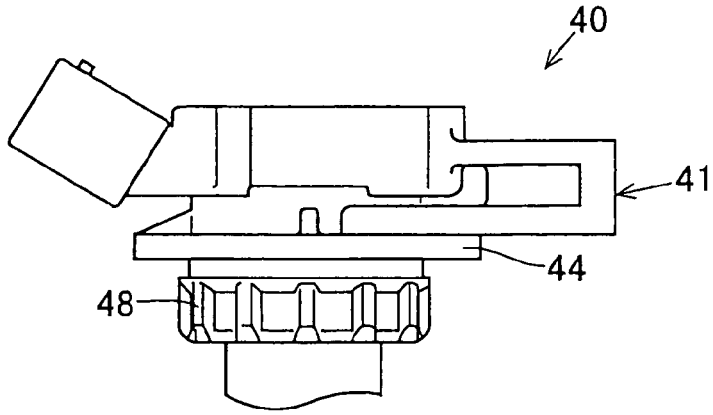
FIG. 4 is an enlarged side view showing the coil portion and the control portion of the ignition coil according to the first embodiment.

As shown in FIGS. 1, 4, multiple axial protrusions (upper positioning portions, first positioning portions) 48 are formed in the vicinity of the lower end portion of the connecting portion 44. Each axial protrusion 48 axially extends substantially in the vertical direction in FIG. 4. The axial protrusion 48 may be formed simultaneously with forming of the upper case 41. The height of the axial protrusion 48 is in a range from substantially 3 mm to substantially 20 mm. The axial protrusions 48 protrudes from the outer circumferential periphery of the lower end portion of the connecting portion 44 in a substantially radial direction of the connecting portion 44.

All the axial protrusions 48 are in a substantially the same shape such as a substantially semicircular shape in cross section. The axial protrusion 48 extends in parallel with the axis of the connecting portion 44. The axial protrusions 48 are arranged in the circumferential direction of the connecting portion 44 at predetermined intervals.

As referred to FIG. 3, the outer diameter of the axial protrusions 48 is D1, i.e., the length between a tip end of one of the axial protrusions 48 and a tip end of one of the axial protrusions 48, which are radially opposite to each other, is D1. Alternatively, the diameter of the circle circumscribed along the radially tip ends of the axial protrusions 48 is D1. The inner diameter of the large-diameter short hole 67 is d1. The gap formed between a tip end of one of the axial protrusion 48 and the inner circumferential periphery of the large-diameter short hole 67 has a length L1 in the radial direction thereof. The length L1 is less than the length L2.

The tower portion (high-voltage tower portion) 50 shown in FIG. 5 includes the tower case 51, a rubber cap 55, a spring 57, and the like. The tower case 51, which is in a substantially cylindrical shape, is integrally connected with the primary spool 18 via a connecting portion (second portion) 53 that is in a substantially annular shape. That is, the tower case 51 is integrally formed with the primary spool 18 via the connecting portion 53 to be an integrated member. The upper end portion of the tower case 51 and the lower end portion of the primary spool 18 are connected with each other via the connecting portion 53.

An annular protrusion (lower positioning portion, second positioning portion) 58 is formed on the outer circumferential periphery of the connecting portion 53. The annular protrusion 58 may be formed simultaneously with forming of the connecting portion 53. That is, the second positioning portion 58 is formed on the integrated member that is formed of the tower case 51, the primary spool 18, and the connecting portion 53.

The annular protrusion 58 is formed to be in a substantially semicircular shape in cross-section with respect to the circumferential direction thereof. The height of the annular protrusion 58 is in a range from substantially 0.5 mm to substantially 2.0 mm. The tip end of the annular protrusion 58 on the radially outer side thereof makes contact with the inner periphery of the small-diameter long hole 66 of the plughole 65. Alternatively, the tip end of the annular protrusion 58 on the radially outer side thereof is in proximity radially to the inner periphery of the small-diameter long hole 66 of the plughole 65.

The tower case 51 is inserted into a cylindrical concavity 56 formed in the upper end portion of the rubber cap 55. The spring 57 is provided to a hollow space that is axially formed through the tower case 51 and the rubber cap 55.

As referred to FIG. 3, the outer diameter D3 of the annular protrusion 58 is greater than the outer diameter D2 of the coil portion 10, and is less than the length D1 that is between tip ends of the axial protrusions 48 that are radially opposite to each other. The length D1 is equivalent to the diameter of the circle circumscribed along the tip ends of the axial protrusions 48 perpendicularly to the axial direction of the coil portion 10. The outer circumferential periphery of the annular protrusion 58 and the inner circumferential periphery of the small-diameter long hole 66 form a gap that has a length L3 in the radial direction thereof. The length L3 is less than the length L2 of the gap formed between the outer circumferential periphery of the coil portion 10 and the inner circumferential periphery of the small-diameter long hole 66. The length L3 is greater than the length L1 of the gap formed between a tip end of one of the axial protrusion 48 and the inner circumferential periphery of the large-diameter short hole 67.

Next, an assemble process of the stick-shaped ignition coil is described in reference to FIGS. 2, 5. The control portion 40 (FIG. 2) is assembled to the coil portion 10, which is integrated with the tower portion 50 (FIG. 5), using the terminal assembly 30. Specifically, as referred to FIG. 5, the spring 57 is set to the inside of the tower case 51, subsequently, the thin film sheet 22 and the outer core 23 are set to the side of the outer circumferential periphery of the primary winding 19 that is wound around the primary spool 18. The lower end portion 33 of the terminal assembly 30 is press-inserted into the outer circumferential periphery of the outer core 23. The intermediate portion 32 is press-inserted into the outer circumferential periphery of the thin film sheet 22 that circumferentially covers the collar portion 25 of the primary winding 19. Thus, the terminal assembly 30 seals the gap formed between the primary spool 18 and the thin film sheet 22.

Lead portions of both the primary and secondary windings 19, 15 are upwardly drawn from the upper end plane of the terminal assembly 30 through a hollow space formed in the terminal assembly 30. The lead portion of the primary winding 19 is electrically connected to the primary terminal provided to the terminal assembly 30. The lead portion of the secondary winding 15 is electrically connected to the secondary terminal. The lead portion of the primary winding 19 is electrically connected to the igniter 46 and the terminal 47 that are received in the control portion 40.

Subsequently, the secondary coil 13 is inserted into the inner circumferential periphery of the primary coil 17. The center core 11 is inserted into the inner circumferential periphery of the secondary coil 13. The igniter 46 and the terminal 47 are arranged in the upper case 41 of the control portion 40 in advance. The connecting portion 44 of the upper case 41 is press-inserted into the outer circumferential periphery of the terminal assembly 30. In this situation, melted resin is injected into a space formed in the upper case 41, so that the melted resin flows over the space in the upper case 41. Thus, gaps such as the gap formed between the secondary winding 15 and the primary spool 18, and the gap formed between the primary winding 19 and the thin film sheet 22 can be filled with the melted resin. The control portion 40 is connected with the coil portion 10.

The ignition coil 60, which is completely assembled, is inserted into the plughole 65 formed in the cylinder head 70 from the side of the tower portion (high-voltage tower portion) 50. The ignition coil 60 is inserted into the plughole 65, so that the tip end of the annular protrusion 58, which is formed on the connecting portion 53 (FIG. 5) of the primary spool 18, makes contact with or comes close to the inner circumferential periphery of the small-diameter long hole 66. The tip ends of the axial protrusions 48 (FIG. 4), which are formed on the connecting portion 44 of the upper case 41, make contact with or come close to the inner circumferential periphery of the large-diameter short hole 67 (FIG. 1).

Thus, the ignition coil 60, specifically the coil portion 10 can be radially set at the predetermined position in the plughole 65. The coil portion 10 is in a long slender shape, and a gap is formed between the outer circumferential periphery of the coil portion 10 and the inner circumferential periphery of the small-diameter long hole 66 of the plughole 65. However, even in this structure, the upper and lower end portions of the coil portion 10 can be positioned in the radial direction thereof using the annular protrusion 58 and the axial protrusions 48, so that coil portion 10 can be restricted from radially moving in the plughole 65.

As referred to FIG. 1, the inner diameter d1 of the large-diameter short hole 67 is greater than the inner diameter d2 of the small-diameter long hole 66, so that the control portion 40 can be stably received, i.e., seated in the large-diameter short hole 67. The length L1 of the gap formed between the tip end of one of the axial protrusion 48 and the inner circumferential periphery of the large-diameter short hole 67 is less than the length L2 of the gap formed between the outer circumferential periphery of the coil portion 10, i.e., the outer core 23 and the inner circumferential periphery of the small-diameter long hole 66. Therefore, the axial protrusion 48 makes contact with the inner circumferential periphery of the large-diameter short hole 67 before the coil portion 10 makes contact with the inner circumferential periphery of the small-diameter long hole 66, even when the ignition coil 60 radially moves. Thus, the ignition coil 60 can be further stably restricted in radial movement in the plughole 65.

As referred to FIG. 5, the primary spool 18 is integrally formed with the tower case 51, and the annular protrusion 58 is formed on the connecting portion 53, so that the primary spool 18 and the annular protrusion 58 can be simultaneously formed. Thus, the primary spool 18, the tower case 51, and the annular protrusion 58 can be easily formed. As referred to FIG. 4, the axial protrusions 48 are simultaneously formed with the upper case 41, so that the axial protrusions 48 and the upper case 41 can be easily formed. The tower portion (high-voltage tower portion) 50 does not have a positioning portion that positions the tower portion 50 in the radial direction thereof. However, even in this structure, the tower case 51 is integrally formed with the primary spool 18, and the lower end portion of the primary spool 18 is fixed to the ignition plug 210. That is, the tower portion 50 has a structure that is substantially integrated with the primary spool 18 and the ignition plug 210 that are stably positioned in the plughole 65 and the cylinder head 70, so that the tower portion 50 can be properly positioned in the plughole 65.

The intermediately outer periphery of the coil portion 10 is formed of the thin film sheet 22, and the outermost periphery of the coil portion 10 is formed of the outer core 23. The outer circumferential periphery of the coil portion 10 is exposed without being covered with a cylindrical resinous case, i.e., coil case. The thickness of the thin film sheet 22 is substantially half or substantially one-third of the thickness of a conventional coil case. Therefore, the outer diameter of the coil portion 10 can be significantly reduced in the above structure.

The primary spool 18 of the coil portion 10 is connected with the upper case 41 of the control portion 40 via the terminal assembly 30. Specifically, the upper end portion of the primary spool 18 of the coil portion 10 is press-inserted into the terminal assembly 30, and the upper case 41 of the control portion 40 is press-inserted into the terminal assembly 30. Therefore, shortage of rigidity of the thin film sheet 22 can be compensated by the rigid structure of the entire coil portion 10. Thus, the coil portion 10, which has the intermediately outer periphery formed of the thin film sheet 22, can be steadily connected with the control portion 40.

The terminal assembly 30 seals the gap formed between the primary spool 18 and the thin film sheet 22. Besides, the terminal assembly 30 seals the gap formed between the primary spool 18 and the upper case 41. Therefore, the electrically insulative resin such as epoxy resin injected into the space formed in the coil portion 10 can be protected from leakage through the gaps.

Second Embodiment

Figure 6:
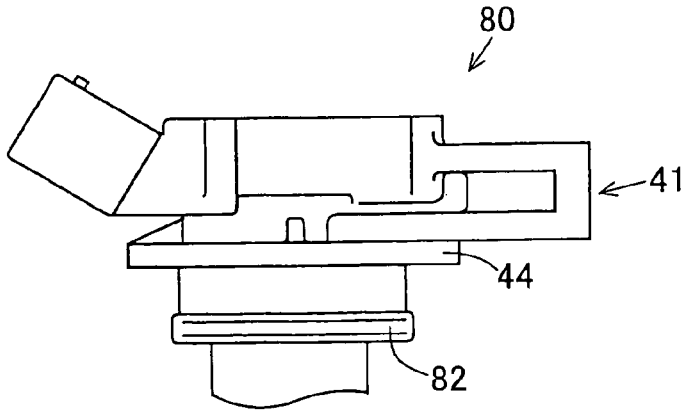
FIG. 6 is an enlarged side view showing a coil portion and a control portion of an ignition coil according to a second embodiment of the present invention.
Figure 7:
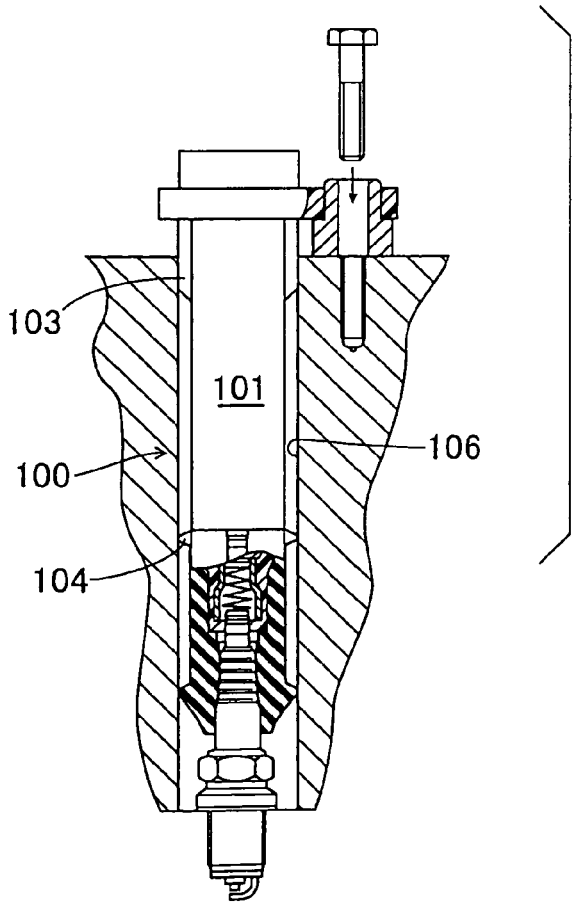
FIG. 7 PRIOR ART
FIG. 7 is a partially cross-sectional side view showing an ignition coil according to a prior art.

As shown in FIG. 6, an annular protrusion (first positioning portion) 82 is formed on the connecting portion 44 of the upper case 41 of the control portion 80 instead of the axial protrusions 48. The annular protrusion 82 has a width, i.e., thickness in the width direction (axial direction) of the annular protrusion 82 that is equivalent to the length of the axial protrusions 48. The height, i.e., the amount of protrusion of the annular protrusion 82 in the radial direction of the connecting portion 44 is equivalent to the amount of protrusion of the axial protrusions 48. The structure of the ignition coil of this embodiment is substantially the same as the structure of the first embodiment excluding the annular protrusion 82. The annular protrusion 82 in this embodiment has a shape simpler compared with the shape of the axial protrusions 48, so that the annular protrusion 82 can be easily formed simultaneously with forming the upper case 41.

The positioning portions 48, 58, 82, i.e., the axial protrusions 48, the annular protrusions 58, 82 are respectively formed on axially intermediate portions of the ignition coil 60. The axially intermediate portions of the ignition coil 60 are axially apart from the axially middle portion of the ignition coil 60 in the axial direction of the ignition coil 60. The axially middle portion of the ignition coil 60 is located in the center of the ignition coil 60 in the axial direction of the ignition coil 60. Thus, the outer core 23 of the ignition coil 60 can be stably positioned in the radial direction of the plughole 65 by the positioning portions 48, 58, 82.

The ignition coil 60 can be stably positioned in the plughole 65 by the upper case 41 of the control portion 40 without reducing the length of the coil portion 10 in the above structure of the ignition coil 60.

The annular protrusion 58 is proximity to or makes contact with the inner periphery of the small-diameter long hole 66 at an intermediate portion between the coil portion 10 and the tower portion 50. The intermediate portion between the coil portion 10 and the tower portion 50 is located at a substantially middle position of the total length of both the coil portion 10 and the tower portion 50. Thus, the ignition coil 60 can be stably positioned by the annular protrusion 58.

The cylinder head 70 constructs a lid member of a cylinder block of the internal combustion engine 200 for an automobile such as a vehicle. The plughole 65 is formed in the cylinder head 70 in the direction of the thickness of the cylinder head 70. The plughole 65 includes the large-diameter short hole 67 and the small-diameter long hole 66. The large-diameter short hole 67 is located on the side of the inlet, i.e., opening of the plughole 65. That is, the large-diameter short hole 67 is located on the opposite side as the combustion chamber 220, which is formed in the internal combustion engine 200, with respect to the small-diameter long hole 66.

The small-diameter long hole 66 is located on the side of the intermediate portion of the plughole 65, or located on the side of the deep portion of the plughole 65. The control portion 40 is at least partially inserted to the large-diameter short hole 67, so that the control portion 40 is at least partially received in the large-diameter short hole 67. The length of the large-diameter short hole 67 in the axial direction of the plughole 65 may be small, however, the inner diameter of the large-diameter short hole 67 needs to be large. The coil portion 10 and the tower portion 50 are inserted into the small-diameter long hole 66 of the plughole 65. The inner diameter of the small-diameter long hole 66 may be small, however, the length of the small-diameter long hole 66 in the axial direction of the plughole 65 needs to be large.

The center core 11 and the outer core 23 are made of a magnetic material. The outer core 23 is substantially coaxially arranged with respect to the center core 11 on the radially outer side of the center core 11, so that the outer core 23 and the center core 11 form a closed magnetic circuit. Any member is not provided to the radially outer side of the outer core 23, so that the outer circumferential periphery of the outer core 23 exposes to the outermost periphery of the coil portion 10. Thus, the outer diameter of the coil portion 10 becomes small.

The terminal assembly 30, which is formed in a substantially cylindrical shape, has a predetermined length in the axial direction of the terminal assembly 30. The inner periphery of the terminal assembly 30 has a predetermined shape and a predetermined dimension, so that the terminal assembly 30 can be stably press-inserted to the primary spool 18. The outer periphery of the terminal assembly 30 has a predetermined shape and a predetermined dimension that are suitable to be press-inserted into the upper case 41 of the control portion 40. The outer diameter of the outer periphery of the terminal assembly 30 and the inner diameter of the inner periphery of the terminal assembly 30 may be uniform over the total axial length of the terminal assembly 30, and may be changed lengthwise in the terminal assembly 30.

The cylindrical thin film sheet 22, which is electrically insulative, has a thickness, which is in a range from substantially 0.1 mm to substantially 0.3 mm.

The control portion 40, which switches primary current supplied to the primary coil 17, may be directly connected to the coil portion 10 without providing the connecting portion 44 therebetween.

The tower portion 50, which supplies the ignition plug 210 with high-voltage secondary current, may be connected to the primary spool 18 via a tower case 51 that is separate from both the tower portion 50 and the primary spool 18. The tower portion 50 may be integrally formed directly with the primary spool 18.

The positioning portions 48, 58, 82 are formed on portions of the ignition coil 60, which are away from the axially middle portion of the outer core 23. The positioning portions 48, 58, 82 may be formed at a portion that is completely apart from the outer core 23 in the axial direction of the outer core 23. Alternatively, the positioning portions 48, 58, 82 may be formed on axial end portions of the outer core 23 of the ignition coil 60. The outer core 23 may be arranged substantially over the entire portion of the coil portion 10 lengthwise. In this structure, at least one of the axial protrusions 48, the annular protrusion 82, and the annular protrusion 58, which are positioned to be upwardly and downwardly away from the middle portion of the outer core 23, are arranged at both the upper and lower end portions of the coil portion 10. Alternatively, in this structure, at least one of the axial protrusions 48, the annular protrusion 82, and the annular protrusion 58 may be arranged in the vicinities of both the upper and lower end portions of the coil portion 10.

Specifically, the axial protrusions 48 and/or the annular protrusion 82 may be arranged at the upper case 41 that is located on the upper side, i.e., the side of the control portion 40 axially apart from the outer core 23. The annular protrusion 58 may be arranged at a connecting portion 53 that is located on the lower side in FIG. 5, i.e., the side of the tower portion 50 axially apart from the outer core 23. The shape of the positioning portions 48, 58, 82 may be the same as each other, or may be different from each other. The number of the positioning portions 48, 58, 82, i.e., the axial protrusions 48, the annular protrusion 82, and annular protrusions 58 may be the same as each other, and may be different from each other. The shape and the number of the positioning portions 48, 58, 82 may be determined as appropriate. The lower end portion of the connecting portion 44 downwardly extends from the receiving portion 42 of the upper case 41 of the control portion 40, so that the upper case 41 can be inserted to the primary spool 18. The upper case 41 opposes to the large-diameter short hole 67 of the plughole 65 in the radial direction of the plughole 65, when the upper case 41 is at least partially received in the large-diameter short hole 67. At least one annular protrusion 82 may be formed on the upper case 41 to extend in the substantially circumferential direction of the large-diameter short hole 67. The axial protrusions 48 may be formed on the upper case 41 to extend in the substantially axial direction of the large-diameter short hole 67. The thin film sheet 22 may have a portion, which is not circumferentially covered with the outer core 23, on the upper side thereof. In this structure, the axial protrusions 48 and/or the annular protrusion 82 may be formed on the portion of the thin film sheet 22, which is not covered with the outer core 23; i.e., which exposes to the radially outer periphery of the ignition coil 60.

The connecting portion 53 is included in the coil portion 10 and/or the tower portion 50. The connecting portion 53 radially oppose to the small-diameter long hole 66 of the plughole 65. When the primary spool 18 of the coil portion 10 is a member, which is separate from the tower case 51 of the tower portion 50, the annular protrusion 58 may be formed on at least one of the primary spool 18 and the tower case 51. Specifically, the annular protrusion 58 may be formed in the vicinity of the lower end portion of the primary spool 18. Besides, the annular protrusion 58 may be formed in the vicinity of the upper end portion of the tower case 51. When the primary spool 18 is integrated with the tower case 51, the annular protrusion 58 may be formed on a portion that is in a boundary between the primary spool 18 and the tower case 51. That is, the tower case 51 is integrally formed with the primary spool 18 to be an integrated member 18, 14, and the second positioning portion 58 may be formed on the integrated member 18, 14.

The annular protrusion 58 is constructed of at least one annular protrusion that substantially circumferentially extends. At least one lib 58, which substantially axially extends, may be formed on the ignition coil 60 instead of the annular protrusion 58. Alternatively, at least one lib 58 may be formed in addition to the annular protrusion 58. The annular protrusion 58 need not to be formed on the ignition coil 60. Even when the annular protrusion 58 is not formed on the ignition coil 60, the axial end portion of the tower portion 50 is connected to the ignition plug 210, so that the connection between the end portion of the tower portion 50 and the ignition plug 210 may become a rigid positioning structure.

The primary coil 17 may be arranged on the inner peripheral side with respect to the secondary coil 13 in the radial direction of the coil portion 10. Even in this structure, current can be supplied and shut by the igniter 46, so that high-voltage current can be generated using the primary and secondary coils 13, 17, as well as a generally known ignition coil.

A resinous cylindrical member may be provided between the primary spool 18 and the outer core 23.

Various modifications and alternations may be diversely made to the above embodiments without departing from the spirit of the present invention.

What is claimed is:

1. A stick-shaped ignition coil that is received in a plughole formed in a cylinder head of an internal combustion engine, the stick-shaped ignition coil comprising:

a coil portion that includes:

a center core;

a secondary coil that is arranged on an outer circumferential side of the center core, the secondary coil including a secondary spool and a secondary winding, the secondary winding wound around the secondary spool;

a primary coil that is arranged on an outer circumferential side of the center core, the primary coil including a primary spool and a primary winding, the primary winding wound around the primary spool, wherein the secondary coil and the primary coil are substantially coaxially arranged; and an outer core that is arranged on an outer circumferential side of one of the primary coil and the secondary coil that is arranged on an outer circumferential side with respect to the other of the primary coil and the secondary coil, the outer core arranged on an outermost side of the coil portion in a radial direction of the coil portion, the outer core having a middle portion that is located at a center of the outer core in an axial direction of the outer core;

a first portion that is connected to an upper end portion of the coil portion, the first portion apart from the middle portion of the outer core in the axial direction of the outer core; and at least one first positioning portion that is formed on the first portion, wherein the at least one first positioning portion is in proximity to an inner circumferential periphery of a first hole portion, which is formed in the plughole, in the radial direction of the plughole.

2. The stick-shaped ignition coil according to claim 1, wherein the at least one first positioning portion makes contact with the inner circumferential periphery of the first hole portion, which is formed in the plughole, in the radial direction of the plughole.

3. The stick-shaped ignition coil according to claim 1, wherein the upper end portion of the coil portion is located on an opposite side as an ignition plug, which is inserted into a combustion chamber formed in the internal combustion engine, with respect to the outer core.

4. The stick-shaped ignition coil according to claim 1, wherein the first portion is an upper case, and the plughole has the first hole portion and a second hole portion, and the first hole portion is formed on a side of an inlet of the plughole with respect of the second hole portion.

5. The stick-shaped ignition coil according to claim 1, wherein the first hole portion is arranged on an opposite side as the combustion chamber, which is formed in the internal combustion engine, with respect to the second hole portion.

6. The stick-shaped ignition coil according to claim 4, wherein the first hole portion has an inner diameter that is greater than an inner diameter of the second hole portion.

7. The stick-shaped ignition coil according to claim 1, wherein the first portion is at least partially received in the first hole portion, the at least one first positioning portion is formed on an outer circumferential periphery of the first portion such that the at least one first positioning portion is at least partially received in the first hole portion, and the at least one first positioning portion is at least partially in proximity to the inner circumferential periphery of the first hole portion in the radial direction of the plughole.

8. The stick-shaped ignition coil according to claim 1, wherein the at least one first positioning portion at least partially make contact with the inner circumferential periphery of the first hole portion in the radial direction of the plughole.

9. The stick-shaped ignition coil according to claim 6, wherein the upper case includes a receiving portion and a connecting portion, the connecting portion protrudes from the receiving portion to the side of the coil portion in a substantially axial direction of the coil portion, the connecting portion connects to an upper end portion of one of the primary spool and the secondary spool that is arranged on the outer circumferential side with respect to the other of the primary spool and the secondary spool in the coil portion, and the first positioning portion is formed on the connecting portion.

10. The stick-shaped ignition coil according to claim 9, wherein the first positioning portion is formed on an outer circumferential periphery of the connecting portion.

11. The stick-shaped ignition coil according to claim 9, wherein the first positioning portion is at least one of an annular protrusion and a plurality of axial protrusions, the annular protrusion has a substantially annular shape, the annular protrusion protrudes in a radial direction of the connecting portion, each axial protrusion protrudes in a substantially radial direction of the connecting portion, and the axial protrusion extends in a substantially axial direction of the coil portion.

12. The stick-shaped ignition coil according to claim 1, wherein the first positioning portion has a circumscribed circle perpendicularly to an axial direction of the coil portion, and difference between a diameter of the circumscribed circle of the first positioning portion and an inner diameter of the first hole portion is less than difference between an outer diameter of the coil portion and an inner diameter of the second hole portion.

13. The stick-shaped ignition coil according to claim 1, wherein the first positioning portion has a tip end that oppose to an inner periphery of the first hole portion in the radial direction of the plughole, the tip end of the first positioning portion and the inner periphery of the first hole portion form a first gap therebetween in the radial direction of the plughole, the second hole portion has an inner periphery that oppose to an outer periphery of the coil portion in the radial direction of the plughole, the inner periphery of the second hole portion and the outer periphery of the coil portion form a second gap therebetween in the radial direction of the plughole, and the first gap is smaller than the second gap.

14. The stick-shaped ignition coil according to claim 1, further comprising:

a second portion that is apart from the middle portion of the outer core in the axial direction of the outer core; and a second positioning portion that is formed on the second portion, wherein the second positioning portion is located on an opposite side as the at least one first positioning portion with respect to the outer core, and the second positioning portion is in proximity to an inner circumferential periphery of the second hole portion of the plughole in the radial direction of the plughole.

15. The stick-shaped ignition coil according to claim 14, wherein the second positioning portion makes contacts with the inner circumferential periphery of the second hole portion in the radial direction of the plughole.

16. The stick-shaped ignition coil according to claim 14, wherein the second portion is a lower end portion of the one of the primary spool and the secondary spool that is arranged on the outer circumferential side with respect to the other of the primary spool and the secondary spool, the second hole portion is a small diameter hole portion, the small diameter hole portion has an inner diameter that is smaller than an inner diameter of the first hole portion, and the second hole portion is formed in an intermediate portion of the plughole.

17. The stick-shaped ignition coil according to claim 16, wherein the second portion is located on an opposite side as the first portion with respect to the outer core, and the second hole portion is located between the first hole portion and a combustion chamber, which is formed in the internal combustion engine, in an axial direction of the plughole.

18. The stick-shaped ignition coil according to claim 16, further comprising:

a high-voltage tower portion that includes a tower case integrally formed with the one of the primary spool and the secondary spool, which is arranged on the outer circumferential side with respect to the other of the primary spool and the secondary spool in the coil portion, to be an integrated member, wherein the second positioning portion is formed on the integrated member.

19. The stick-shaped ignition coil according to claim 18, wherein the second positioning portion is at least one annular protrusion that has a substantially annular shape.

20. The stick-shaped ignition coil according to claim 19, wherein the second positioning portion protrudes in a radial direction of the second portion.

21. The stick-shaped ignition coil according to claim 1, wherein the outer core exposes to an outer circumferential periphery of the coil portion.

22. The stick-shaped ignition coil according to claim 21, wherein the outer core is formed of a metallic material.

* * * * *